US008028873B2

(12) United States Patent
Hawk et al.

(10) Patent No.: US 8,028,873 B2
(45) Date of Patent: Oct. 4, 2011

(54) RATCHET TYPE POCKET CLIP

(75) Inventors: Grant W. Hawk, Idaho City, ID (US); Gavin D. Hawk, Idaho City, ID (US)

(73) Assignee: KAI U.S.A., Ltd., Tualatin, OR (US)

( * ) Notice: Subject to any disclaimer, the term of this patent is extended or adjusted under 35 U.S.C. 154(b) by 1150 days.

(21) Appl. No.: 11/760,608

(22) Filed: Jun. 8, 2007

(65) Prior Publication Data

US 2008/0302842 A1 Dec. 11, 2008

(51) Int. Cl.
*A45F 5/02* (2006.01)

(52) U.S. Cl. ..... 224/269; 224/667; 224/666; 24/3.12

(58) Field of Classification Search ..... 224/269, 224/666, 667; 24/3.11, 3.12; 248/690–692; 220/482; 81/177.4; 40/16, 80, 115; 30/151, 30/160, 161
See application file for complete search history.

(56) References Cited

U.S. PATENT DOCUMENTS 1,347,090 A * 7/1920 Hahn ..... 24/11 M
1,644,668 A * 10/1927 Clyne ..... 101/3.1
1,850,796 A * 3/1932 Hopkins ..... 24/11 M
4,347,665 A * 9/1982 Glesser ..... 30/161
4,903,375 A * 2/1990 DiFranco ..... 24/3.3
5,305,502 A * 4/1994 Abrahams ..... 24/517
6,684,465 B1 * 2/2004 Jo ..... 24/344
6,695,512 B1 * 2/2004 Sutherland ..... 401/117
2002/0083558 A1 * 7/2002 Tsou ..... 24/3.12

* cited by examiner

*Primary Examiner* — Justin Larson
*Assistant Examiner* — Corey Skurdal
(74) *Attorney, Agent, or Firm* — Seed IP Law Group PLLC

(57) ABSTRACT

A pocket clip is attached at a first end to a tool such as a folding knife. A roller assembly is provided at a second end of the clip with a portion extending toward the tool. The roller assembly includes a ratchet wheel between a pair of elastomeric roller wheels. A pawl engages the ratchet wheel and limits rotation of the roller assembly such that the assembly rotates in one direction around an axis transverse to a longitudinal axis of the tool, and resists rotation in an opposite direction. When the tool is positioned in a user's pocket, a panel of the pocket engages the roller assembly, which rotates substantially freely, permitting the pocket panel to slide easily between the pocket clip and the surface of the tool. However, the roller assembly resists movement of the pocket panel in the opposite direction, holding the tool securely in the pocket.

5 Claims, 3 Drawing Sheets

RATCHET TYPE POCKET CLIP

FIELD OF THE INVENTION

The present disclosure is related to a pocket clip for holding a tool, such as a folding knife, in a user's pocket, and in particular to a clip that moves easily onto a pocket panel but resists movement in the opposite direction.

BACKGROUND OF THE INVENTION

Folding knives have been popular for centuries because of their relative safety and convenience. They have found use in an extremely wide range of applications, and are especially popular among sportsmen and individuals who work outdoors. In recent years, pocket clips attached to such knives have become popular as they allow a user to clip the knife to a pocket panel rather than placing the knife at the bottom of the pocket, which may improve comfort of the user while carrying the knife, reduce bulkiness in the pocket, and hold the knife more securely against accidental loss.

Representative examples of folding knives with pocket clips may be found in U.S. Pat. No. 4,347,665, issued Sep. 7, 1982 to Glesser, and D488,045, issued Apr. 6, 2004 to Onion; and in U.S. patent application Ser. No. 11/701,119, filed Jan. 31, 2007, in the names of the present inventors.

BRIEF SUMMARY OF THE INVENTION

According to an embodiment of the invention, a pocket clip is provided for attachment to a tool to enable a user to clip the tool to a pocket. The pocket clip is attached at a first end to the tool, with a surface of the pocket clip facing a surface of the tool. A roller assembly is provided at a second end of the clip with a portion of the roller assembly extending toward the tool. The roller assembly is configured to rotate in one direction around an axis of rotation that is transverse to a longitudinal axis of the clip, and to resist rotation in an opposite direction. The roller assembly includes a ratchet wheel between a pair of elastomeric roller wheels. A pawl coupled to the clip engages the ratchet wheel and limits rotation of the roller assembly to the one direction of rotation.

When the tool is positioned in a user's pocket such that a panel of the pocket engages the roller assembly, then slid into the pocket, the roller assembly rotates substantially freely, permitting the pocket panel to slide easily between the pocket clip and the surface of the tool. However, the roller assembly resists movement of the pocket panel in the opposite direction, holding the tool securely in the pocket.

BRIEF DESCRIPTION OF THE SEVERAL VIEWS OF THE DRAWING(S)

DETAILED DESCRIPTION OF THE INVENTION

While pocket clips for use with folding knives and other small tools are well known in the art, most known pocket clips are subject to a number of potential problems. For example, in order to secure a tool in a user's pocket, a pocket clip must be provided with a degree of spring bias so as to pinch the material of the pocket between the pocket clip and the tool. The strength of the bias must be relatively greater where the associated tool is relatively more massive. Thus, where a clip for a lightweight pencil or pen may require only a minimal amount of bias force, a clip for a larger tool, such as a folding knife, will require proportionately greater bias force to hold the tool securely in the user's pocket. This greater bias has an increased tendency to wear out the upper edge of the pocket panel where the clip first engages the panel when the tool is inserted into the pocket, and the outer surface of the pocket panel where the clip pinches the material of the panel. If the amount of bias is reduced to minimize wear and tear on the material of the pocket, the tool will have a correspondingly greater tendency to fall from the pocket when the pocket is jostled or inverted. Finally, clips according to the known art tend to have a limited range of material thicknesses that they can tolerate, such that a clip designed to secure a tool to the panel of a thin dress shirt pocket may be bent or broken if the user attempts to clip the tool to the relatively thicker material of a denim trouser pocket. Conversely, a clip that functions satisfactorily with the thicker material may fail to securely hold its associated tool to the thinner material of the shirt pocket.

Figure 1:
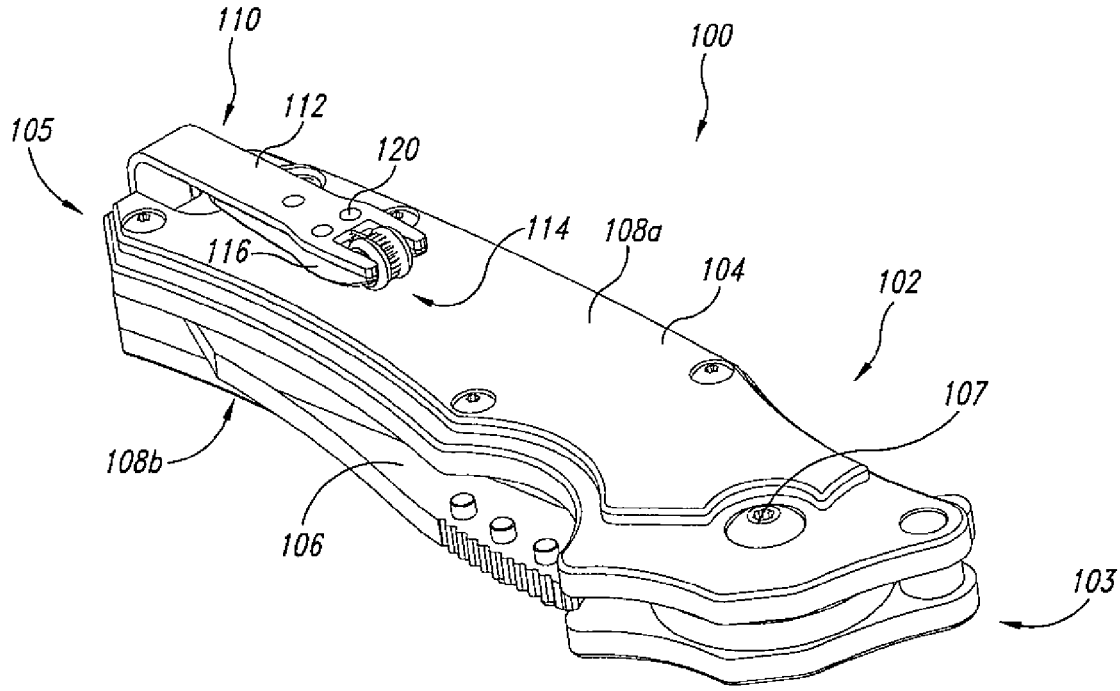
FIG. 1 shows a perspective view of a folding knife with a pocket clip according to an embodiment of the invention.
Figure 2:
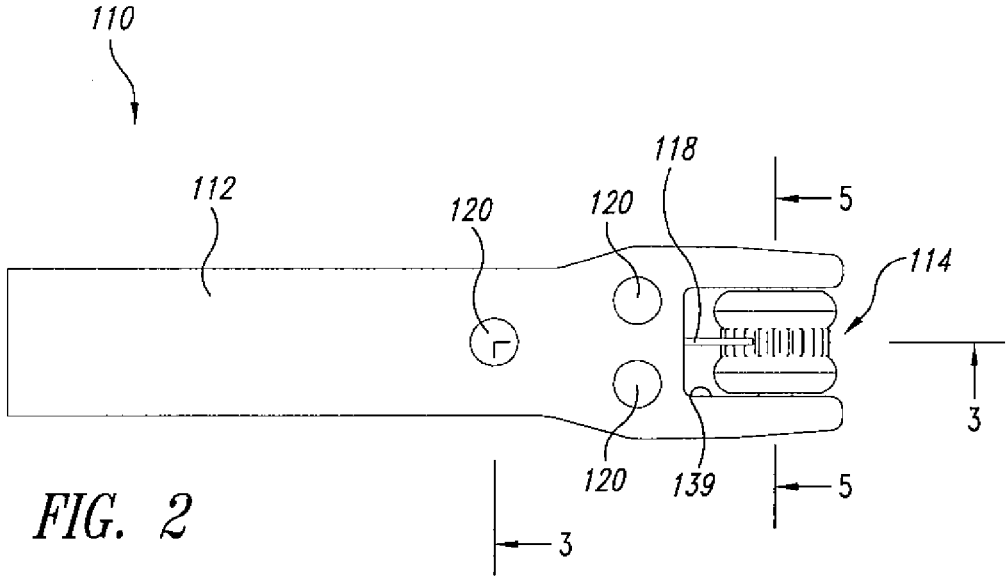
FIG. 2 is a plan view illustration of the pocket clip of the embodiment of FIG. 1.

According to an embodiment of the invention, a pocket clip is provided, configured to be attached to a tool for secure placement within a pocket. For example, as shown in FIG. 1, an assembly 100 includes a folding knife 102 and a clip assembly 110. The clip assembly 110 is shown in detail in FIGS. 2-5, and will be described hereafter with reference to FIGS. 1-6.

The knife 102 comprises a handle 104 and a blade 106. The handle 104 includes upper and lower sides 108*a*, 108*b*. The handle 104 may, according to various embodiments, include any of scales, liners, bolsters, or any other handle element known in the art. The blade 106 is coupled to the handle at a first end 103 of the knife 102 and configured to rotate around a pivot point 107 between an open and a closed position, such as is well known in the art. The clip assembly 110 is coupled at a second end 105 of the knife 102.

Figure 3:
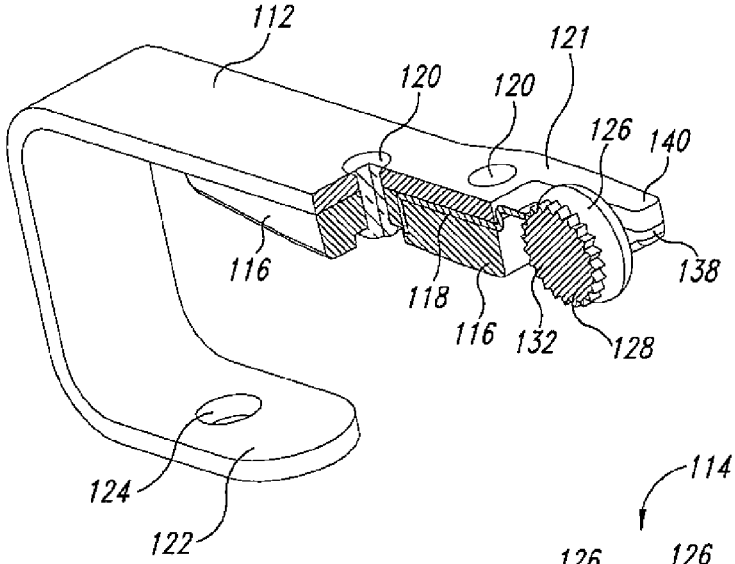
FIG. 3 is a partial cutaway view of the pocket clip of FIG. 2 taken along the lines 3-3 of FIG. 2.

As shown in FIG. 3, the clip assembly 110 includes a clip arm 112 having first and second ends 121, 122, a roller assembly 114 rotatably coupled at the first end 121 of the clip arm 112, a mounting aperture 124 at the second end 122, and a clip plate 116 coupled to an inner surface of the clip arm. A plurality of fasteners 120 hold the clip plate 116 firmly attached to the clip arm 112. In the example shown, the fasteners 120 are rivets. However, any appropriate fastening means may be employed, such as, for example, screws, clips, adhesive, or other appropriate means.

According to an embodiment, the clip arm 112 is formed of a material that has at least a degree of spring-like resilience, such as, for example, steel or titanium. As shown in FIG. 3, the clip arm 112 of the illustrated embodiment is bent such that the clip arm 112 has a "J" shape. Mount aperture 124 is provided at the second end 122 of the clip arm 112 for attachment to the knife 102. The clip assembly 110 is coupled, via the mount aperture 124, to the lower side 108*b* of the knife handle 104 and, because of the bends provided in the clip arm 112, the first end 121 of the clip arm 112 extends substantially parallel to an outer surface of the upper side 108*a* of the handle 104. The roller assembly 114 is coupled to the clip arm 112 such that a lower portion of the roller assembly 114 extends beyond the inner surface of the clip arm 112 toward the outer surface of the upper side 108*a* of the handle 104. The clip assembly 110 is sized and configured such that the lower portion of the roller assembly 114 is positioned adjacent to, or biased against, the outer surface of the first side 108*a*. In use, the added length of the clip arm 112 provided by the bends and the coupling at the lower side 108*b* of the handle 104 provide improved its spring characteristics and allow the clip assembly 110 to properly engage a wider range of material thicknesses than would otherwise be possible, given the overall length of the clip assembly 110 relative to the length of the handle 104.

Figure 5:
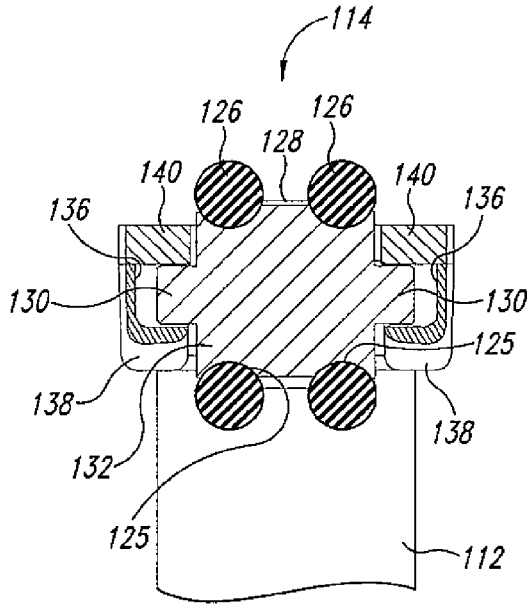
FIG. 5 is a transverse cross-sectional view of the pocket clip of FIG. 2 taken along lines 5-5.

The first end 121 of the clip plate 112 is forked, forming tines 140, and the clip plate 116 is correspondingly forked at an end corresponding to the first end 121 of the clip arm 112, with tines 138, 140 of the clip plate 116 and clip arm 112 being separated by a space 139 sufficient to receive the roller assembly 114 therein. Axle sockets 136 are formed in an upper surface of the tines 138 of the clip plate 116. A pawl channel 142 is also formed in the clip plate 116, terminating at the space 139. A pawl 118 is positioned within the pawl channel 142, extending into the opening 139. As best illustrated in FIGS. 3 and 5, the pawl 118 is a length of spring wire, bent to conform to the shape of the pawl channel 142 and to properly engage the roller assembly 114. The pawl 118 is captured by the clip arm 112, and because of its shape, is maintained in its correct orientation with respect to the roller assembly 114. While in this embodiment it is shown as a length of spring wire, the pawl may be any device or mechanism configured to control rotation of the roller assembly 114 as described below.

According to one embodiment, as shown most clearly in FIGS. 3-6, the roller assembly 114 includes a ratchet wheel 128 positioned between a pair of roller wheels 126, and an axle 130. As shown in FIG. 5, a unitary spool 132 comprises the ratchet wheel 128, the axle 130, and annular channels 125 in which the roller wheels 126 are positioned. According to alternative embodiments, some elements of the roller assembly 114 may be omitted or provided separately from others.

Figure 4:
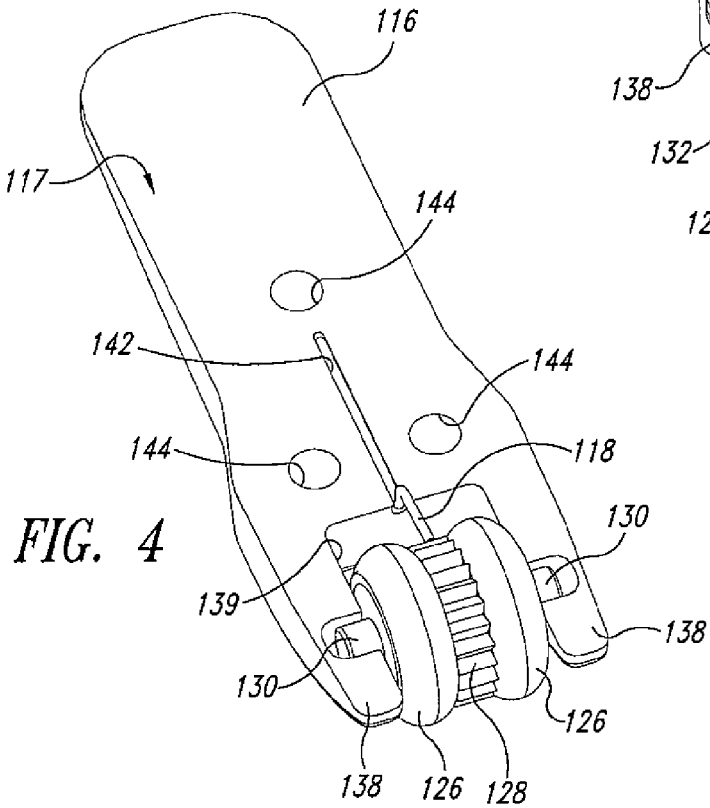
FIG. 4 is a perspective view of a portion of the pocket clip of FIG. 2 showing additional details.
Figure 6:
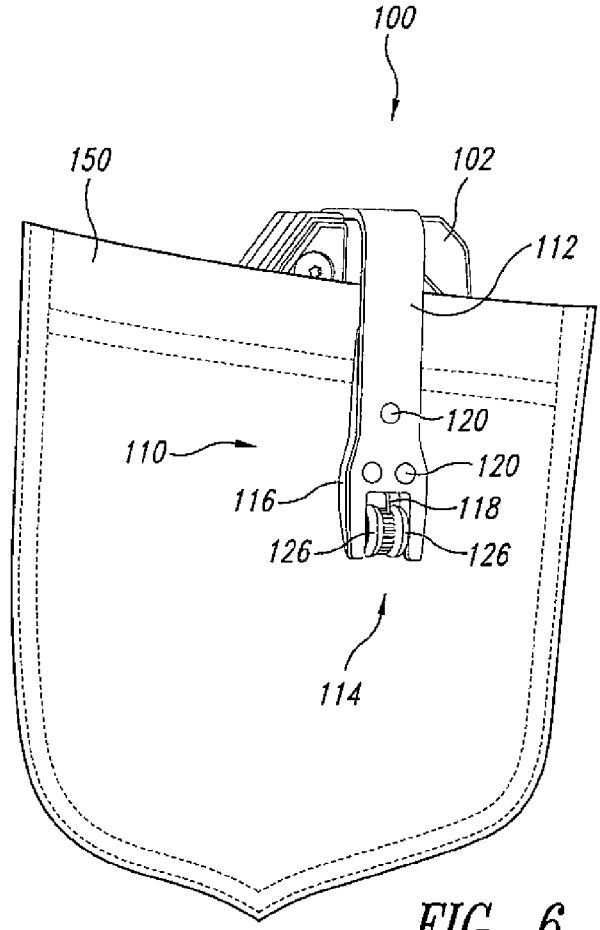
FIG. 6 shows the folding knife of FIG. 1 in a pocket with the pocket clip engaging a panel of the pocket.

The roller wheels 126 are configured to engage an outer surface of a pocket panel with a friction grip, and accordingly are preferably formed of a resilient material such as rubber or other elastomeric material, although any suitable material may be used. As shown in FIGS. 3-5, the roller wheels 126 may be rubber O-rings sized to fit in the annular channels 125. Lower surfaces of the roller wheels 126 extend below a lower surface of the clip plate 116 so as to make contact with the material to which the knife 100 is clipped. First and second ends of the axle 130 rest within the axle sockets 136 of the tines 138 such that at least the ratchet wheel 128 and roller wheels 126 are rotatable around an axis defined by the axle 130. The pawl 118 engages teeth of the ratchet wheel 128 so as to allow the roller wheels to rotate in a first direction R, as shown in FIG. 3, but not in a second direction opposite the first direction.

In operation (see FIG. 6), to clip the assembly 100 of the embodiment of FIGS. 1-6 to a pocket, a user merely places the assembly 100 in a position such that the pocket panel 150 engages the roller wheels 126 at the upper side 108*a* of the handle 104, and slides the knife 102 into the pocket. As the pocket panel 150 slides between the roller wheels 126 and the upper side 108*a*, the roller wheels 126 rotate freely, allowing the knife 102 to move easily into the pocket. Once the knife 102 is in place, the ratchet pawl 118 prevents rotation of the roller wheels 126 in the opposite direction, thereby resisting movement of the knife 102 from its position in the pocket. To remove the knife 102 from the pocket panel 150, the user presses a forefinger or thumb against the first end 121 of the clip arm 112 and pulls upward and outward, i.e., away from the pocket panel 150. A small amount of outward pressure is sufficient to lift the roller wheels 126 from the surface of the pocket panel 150, while the upward pressure slides the knife 102 easily out of the pocket. Alternatively, by merely grasping the knife 100 and pulling upward with sufficient force to overcome the friction generated by the elastomeric material of the roller wheels 126 against the surface of the pocket panel 150, the knife 100 can be removed from the pocket against the resistance of the roller assembly 114.

According to various embodiments of the invention, a number of advantages over the prior art are provided. For example, because of the friction generated between the elastomeric material of the roller wheels 126 and the outer surface of the pocket panel 150, a lower bias force of the clip assembly 110 against the pocket panel 150 is necessary to hold the knife 102 in place, as compared to prior art clips, which reduces wear of the fabric of the panel. Wear is further minimized because the roller wheels 126 roll easily when they are first engaged by the pocket panel 150 and as the knife 102 is slid into the pocket. Additionally, even where the knife is removed from the pocket without lifting the roller assembly 114 from the surface of the pocket panel 150, the elastomeric material of the roller wheels 126 will have a reduced tendency to wear the surface of the pocket panel 150 as compared to prior art clips. Security of the engagement of the pocket panel by the clip assembly is significantly improved over prior art clips, reducing the likelihood that the knife will inadvertently fall from the pocket. Finally, because of the extended length of the clip arm 112 afforded by the coupling of the clip arm at the back of the handle 104, the clip arm 112 is able to flex further without damage and is thus able to accommodate a wider range of thicknesses of material.

Figure 7:
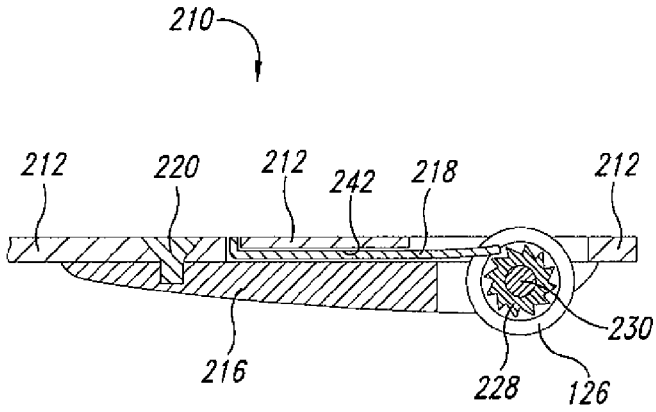
FIG. 7 shows a cross section of a pocket clip according to an alternate embodiment of the invention.

FIG. 7 illustrates a portion of a clip assembly 210 according to an alternate embodiment of the invention. The clip assembly 210 includes a clip arm 212, clip plate 216, clip assembly 214, and ratchet pawl 218. The clip plate 216 is fastened to the clip arm 212 by machine screws 220. A pawl channel 242 is formed in a lower surface of the clip plate 212, and the pawl 218 is captured in the pawl channel 242 by the clip plate 216. A ratchet wheel 228 and roller wheel 126 are rotatably positioned on an axle 230 that, in this embodiment, is a separate element. In operation, the clip assembly 210 functions substantially identically to the clip assembly 110 previously described.

Figure 8:
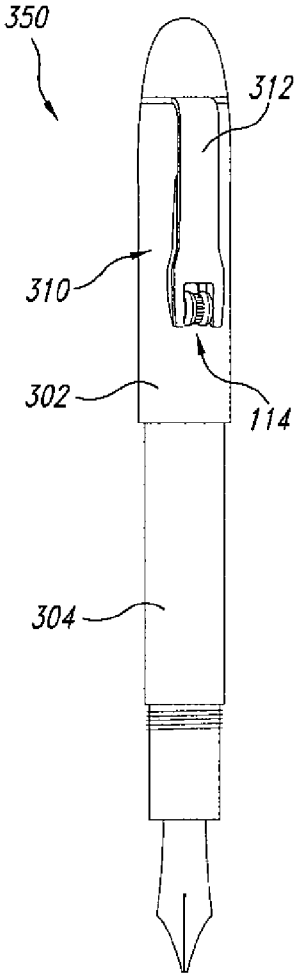
FIG. 8 shows a pocket clip according to an embodiment of the invention attached to a pen.

FIG. 8 illustrates an assembly 350 according to an embodiment of the invention. The assembly 350 comprises a pen body 304, a cap 302, and a pocket clip assembly 310. The pocket clip assembly 310 includes a clip arm 312 by which it is coupled to the cap 302. The pocket clip assembly 310 is substantially similar in operation to previously described embodiments.

While embodiments of the invention have been described with reference to a folding knife and a pen, the principles of the invention can be applied with advantage to any tool that a user might carry in a pocket or clipped to an article of clothing, luggage, etc. A list of such tools includes, for example, various writing instruments, including pens and pencils; hand tools, including screwdrivers, probes, scribers, and pocket flashlights; measuring devices, including rulers, tire gauges, thermometers, and calipers; and electronic devices, including cell phones, MP3 players, PDAs, etc.

Various terms denoting relative position are used in the specification in describing elements of embodiments of the invention. For example, the terms "upper" and "lower" should be construed as they would apply to the knife 100 as oriented in FIG. 1, such that the upper surface of the clip plate 116 is in contact with a lower surface of the first end of the clip arm 112, and lower surfaces of the roller wheels 126 are in contact with an upper surface of the knife handle 104. Terms such as "inner" and "outer" may be construed with reference to an innermost portion of an assembly, such as, with reference to the embodiment of FIGS. 1-6, for example, a central plane of the knife 102 in which the knife blade 106 lies and in which the blade rotates as it moves between the open and a closed positions. Thus, any portion of the assembly 100 that lies further from this plane than another portion may be said to be outside of that other portion. The use of such terms in the specification is for the purpose of simplifying the description of embodiments of the invention, and is not to be construed as limiting the claims, except with respect to claims that explicitly use such terms without otherwise defining them, and then only by the terms actually used.

Where the claims positively recite elements in relation to an object positioned between the recited elements, such as, for example, between an end of a clip assembly and a surface of a tool, the object, per se, is not an element of the claim, but instead is recited to further define aspects of claimed elements, unless the object is positively and explicitly recited as an element.

The generic term "tool," as used in the claims, includes within its scope any device to which the clip may be fastened, and is not limited to the embodiments described in the specification, except where the claims recite such limits.

The abstract of the present disclosure is provided as a brief outline of some of the principles of the invention, according to one embodiment, as an aid to searching. The abstract is not intended as a complete or definitive description of any embodiment thereof, nor should it be relied upon to define terms used in the specification or claims. The abstract does not limit the scope of the claims.

U.S. design patent application Ser. No. 29/280,905, now U.S. Pat. No. D572,562, filed concurrently with the present application and naming the same inventors, is directed to an ornamental design of a folding knife that includes a pocket clip substantially similar to an embodiment disclosed in the present specification.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A device, comprising:

a tool having first and second ends;

a clip assembly having a clip arm with third and fourth ends and being coupled at the third end to the tool, the clip arm extending from the first end of the tool toward the second end of the tool substantially parallel to a surface of the tool, the clip assembly including a roller rotatably coupled at the fourth end of the clip arm, a portion of the roller extending toward the surface of the tool and configured to contact an object positioned between the fourth end of the clip arm and the surface of the tool, the roller having first and second roller wheels and a ratchet wheel positioned between the first and second roller wheels, the roller being configured to rotate substantially freely in a first direction, such that a surface of the roller closest to the surface of the tool is movable toward the first end of the tool, the roller further configured to resist rotation in a second direction opposite the first direction, so that the surface of the roller is not movable toward the second end of the tool, each of the roller wheels having a resilient element configured to generate a degree of friction between the roller and an object positioned between the fourth end of the clip assembly and the surface of the tool, such that movement of the object toward the first end of the tool causes the roller to rotate in the first direction, and movement of the object toward the second end of the tool applies a rotational bias to the roller in the second direction.

2. The device of claim 1 wherein the roller wheels comprise respective O rings.

3. The device of claim 1 wherein the resilient element is formed of an elastomeric material.

4. The device of claim 1 wherein the tool comprises a folding knife.

5. The device of claim 1 wherein the tool is one of a writing instrument, a measuring device, a hand tool, or an electronic device.

* * * * *